US005310379A

United States Patent [19]

Hippely et al.

[11] Patent Number: 5,310,379

[45] Date of Patent: May 10, 1994

[54] MULTIPLE CONFIGURATION TOY VEHICLE

[75] Inventors: Keith A. Hippely, Manhattan Beach; Philip O. Riehlman, Montrose, both of Calif.

[73] Assignee: Mattel, Inc., El Segundo, Calif.

[21] Appl. No.: 12,718

[22] Filed: Feb. 3, 1993

[51] Int. Cl.[5] ..... A63H 13/00; A63H 3/14; A63H 3/46; A63H 17/00

[52] U.S. Cl. ..... 446/279; 446/284; 446/327; 446/376; 446/435

[58] Field of Search ..... 446/269, 273, 279, 284, 446/288, 290, 291, 308, 309, 310, 311, 327, 329, 376, 424, 428, 435, 470, 471, 487

[56] References Cited

U.S. PATENT DOCUMENTS

| | | | |
|---|---|---|---|
| 1,362,248 | 12/1920 | Ford | 446/311 |
| 2,036,328 | 4/1936 | Furey | 446/269 |
| 2,540,317 | 2/1951 | Baggott | 446/428 X |
| 3,603,024 | 9/1971 | Davis | 446/435 X |
| 4,216,612 | 8/1980 | Erickson et al. | 446/290 |
| 4,393,620 | 7/1983 | Murakami | 446/471 X |
| 4,467,556 | 8/1984 | Iwao et al. | 446/470 X |
| 4,516,948 | 5/1985 | Obara . | |
| 4,599,078 | 7/1986 | Obara . | |
| 4,610,639 | 9/1986 | Piazza . | |
| 4,623,316 | 11/1986 | Nagano | 446/487 X |
| 4,654,018 | 3/1987 | Farrington et al. | 446/308 X |
| 4,729,748 | 3/1988 | Van Ruymbeke . | |
| 4,988,320 | 1/1991 | Rankin et al. | 446/376 X |
| 5,052,680 | 10/1991 | Malewicki et al. . | |

FOREIGN PATENT DOCUMENTS

| | | | |
|---|---|---|---|
| 959170 | 2/1957 | Fed. Rep. of Germany | 446/435 |
| 2170726 | 8/1986 | United Kingdom | 446/329 |
| 2201901 | 9/1988 | United Kingdom | 446/291 |

*Primary Examiner*—David N. Muir
*Attorney, Agent, or Firm*—Roy A. Ekstrand

[57] ABSTRACT

A multiple configuration toy vehicle includes an elongated chassis supported by a plurality of wheels. A rear support is pivotally secured to the rear of the chassis. A creature includes a center body, a rear body and head. The head and rear body are pivotally secured to the center body. The rear body is removably securable to the rear support and includes foldable wings which open as the rear body pivots with respect to the center body.

8 Claims, 4 Drawing Sheets

MULTIPLE CONFIGURATION TOY VEHICLE

FIELD OF THE INVENTION

This invention relates generally to toy vehicles and particularly to those multiply configurable to assume alternative appearances.

BACKGROUND OF THE INVENTION

Perhaps one of the most interesting types of toys to emerge in recent years is the style of toys often referred to as "transformers" or "transformable" toys. While the designs and appearances of such toys vary substantially, generally all provide a toy figure comprised of a plurality of multiply articulated members and appendages usually formed of a molded plastic material or the like. The articulated members are pivotable and movable in various often complex paths and orientations to provide the toys with the capability of being configurable into a plurality of relative positions. The combination of different relative positions provide different appearance and character to the toy. In the majority of such toys, the multiply articulated elements are further enhanced with dramatic aesthetic elements to further enhance this duality of appearance. Thus, typical multiple configuration toys provide toy cars or truck vehicles which configure to form robots or the like. Similarly, such toy vehicles often form cars or trucks which are configurable to appear as exaggerated monsters or other creatures.

For example, U.S. Pat. No. 5,052,680 issued to Malewicki, et al. sets forth a TRAILERABLE ROBOT FOR CRUSHING VEHICLES in which a mechanical robot having hydraulically operated arms, mandible claws, neck, head and jaw resembles a giant prehistoric reptile. The reptile is capable of picking up and crushing small toy vehicles and is capable of folding into a rigid structure being attached to a trailer tractor for road hauling on its wheels.

U.S. Pat. No. 4,599,078 issued to Obara sets forth a TRANSFORMABLE TOY ASSEMBLY in which a toy truck vehicle includes a trailer and tractor having a typical vehicle appearance. The toy is formed of a plurality of articulated members which are transformable by rearrangement of the articulated elements to appear in corresponding to a stylized robot.

U.S. Pat. No. 4,516,948 issued to Obara sets forth a RECONFIGURABLE TOY ASSEMBLY having a toy vehicle truck assembly including foldable portion which allow the toy assembly to simulate both a combination tractor and trailer unit of conventional appearance and a highly stylized robotic humanoid form. The trailer unit is reversibly configurable into a play space for the robotic humanoid.

U.S. Pat. No. 4,610,639 issued to Piazza sets forth a SIMULATED FLYING CREATURE WITH FLAPPABLE WINGS having a one piece member supporting a pair of reciprocating wings. A plurality of legs formed on the creature are configured to assist the grasping of the creature during play. The articulated wings are coupled to the body such that finger pressure upon an actuating member causes the wings to flap.

U.S. Pat. No. 4,729,748 issued to VanRuymbeke sets forth a FLYING TOY capable of moving through the air by flapping its wings. The toy includes a body upon which a pair of wings are pivotally secured. A rubber band drive mechanism and winding assembly are supported within the toy body and operatively coupled to the flapping wings such that energy may be stored within the rubber band and drive the wings in a flapping motion to provide flight by the toy.

While the foregoing described prior art devices have enjoyed some measures of success and popularity, there remains nonetheless a continuing need in the art for evermore improved and entertaining and amusing multiple configuration toys.

SUMMARY OF THE INVENTION

According, it is a general object of the present invention to provide an improved multiple configuration toy. It is a more particular object of the present invention to provide an improved multiple configuration toy having simple interactive articulated structure which may be operated by young children to provide an interesting and amusing play pattern.

In accordance with the present invention, there is provided a toy vehicle comprises: a chassis; a pivotal support member pivotally coupled to the chassis; a creature having a center body portion and a rear body portion pivotally coupled thereto; means for attaching the rear body portion to the pivotal support means such that the rear body portion and the center body portion are restable upon the chassis in a relaxed position and pivotable upwardly therefrom in a raised position; a pair of wings; and actuating support means for supporting the pair of wings in a closed position when the rear body portion and the center body portion are in the relaxed position and in an open diverging position when the rear body portion and the center body portion are in the raised position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
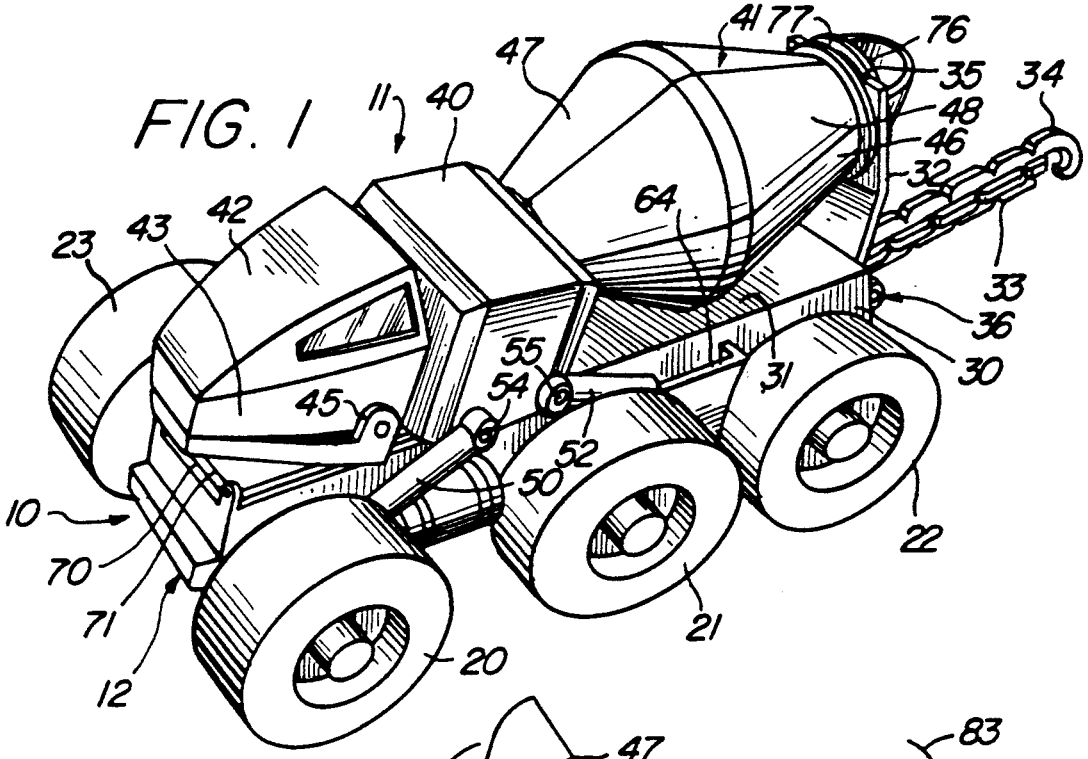
FIG. 1 sets forth a perspective view of the present invention multiple configuration toy vehicle in its toy vehicle appearance configuration.

FIG. 1 sets forth a perspective view of a multiple configuration toy vehicle constructed in accordance with the present invention and generally referenced by numeral 10. Toy vehicle 10 includes a fanciful creature generally referenced by numeral 11 supported upon and combined with a vehicle chassis generally referenced by numeral 12. In the configuration shown in FIG. 1, creature 11 is closed and coupled to chassis 12 to provide an overall appearance replicating a fanciful concrete truck or the like. With temporary reference to FIG. 2, it can be seen that creature 11 is also separable from chassis 12 in accordance with the present invention described below to assume a fanciful insect-like creature having a mechanical appearance similar to a hornet or the like. Returning to FIG. i, chassis 12 supports a plurality of rolling wheels 20, 21, 22, 23, 24 and 25 (wheels 24 and 25 better seen in FIG. 2). Wheels 20 through 25 are coupled to chassis 12 in accordance with conventional fabrication techniques such as the rolling axle attachment shown in FIGS. 8 and 9. Chassis 12 defines an elongated chassis bed 30 defining an upper surface 31 and a pair of claw receptacles 64 and 65 (receptacle 65 better seen in FIG. 2). A lower flap 70 and upper flap 71 having general planar configurations are foldably received upon and pivotally coupled to upper surface 3 of chassis bed 30 in accordance with the structure set forth below in FIGS. 8 and 9. Suffice it to note here, however, that flaps 70 and 71 in the folded position shown in FIG. 1 occupy little or no space and are generally covered by creature 11. Chassis 12 further includes an elongated rearwardly extending simulated chain 33 having a hook 34 formed at the outer end thereof. As is better seen in FIG. 7, simulated chain 33 is pivotally secured to chassis bed 30.

A generally planar upwardly extending rear support 32 defines an upwardly facing notch 35 at the upper end thereof. As is also better seen in FIG. 7, rear support 32 is preferably formed as an integral unit with the pivotal support of simulated chain 33 and is pivotally secured to the rear surface of chassis bed 30 by a horizontal pivot 36. While the structure of horizontal pivot assembly 36 is set forth below in greater detail, suffice it to note here that pivotal assembly 36 permits rear support 32 to pivot downwardly from the position shown in FIG. 1 to the angled position shown in FIG. 2.

Creature 11 includes a center body portion 40 defining a generally rectangular configuration and a generally wedge-shaped head portion 42. By means set forth below in greater detail, head 42 is loosely coupled to center body 40 and is pivotable with respect thereto. Head 42 defines a fixed upper jaw 43 and a movable lower jaw 44. The latter is pivotally coupled to head 42 by a conventional hinge 45. In its preferred form, lower jaw 44 is freely movable and is maintained in the closed position of FIG. 1 due to the weight of head 42 resting upon lower jaw 44 against upper flap 71. Creature 11 further includes a rear body 42 having a lower portion 46 and a pair of wings 47 and 48. In its preferred form, lower portion 46 generally forms the lower half of rear body 41 while wings 47 and 48 form generally equal quarter sections of rear body 41. In the closed position shown in FIG. 1, wings 47 and 48 are closed upon lower portion 46 to form a generally closed member for rear body 41. A generally circular flange 76 is integrally formed with lower portion 46 and defines an annular groove 77 at the center portion thereof. Flange 76 is received within notch 35 of rear support 32 in the closed position shown in FIG. 1 such that rear support 32 is received within groove 77.

Figure 2:
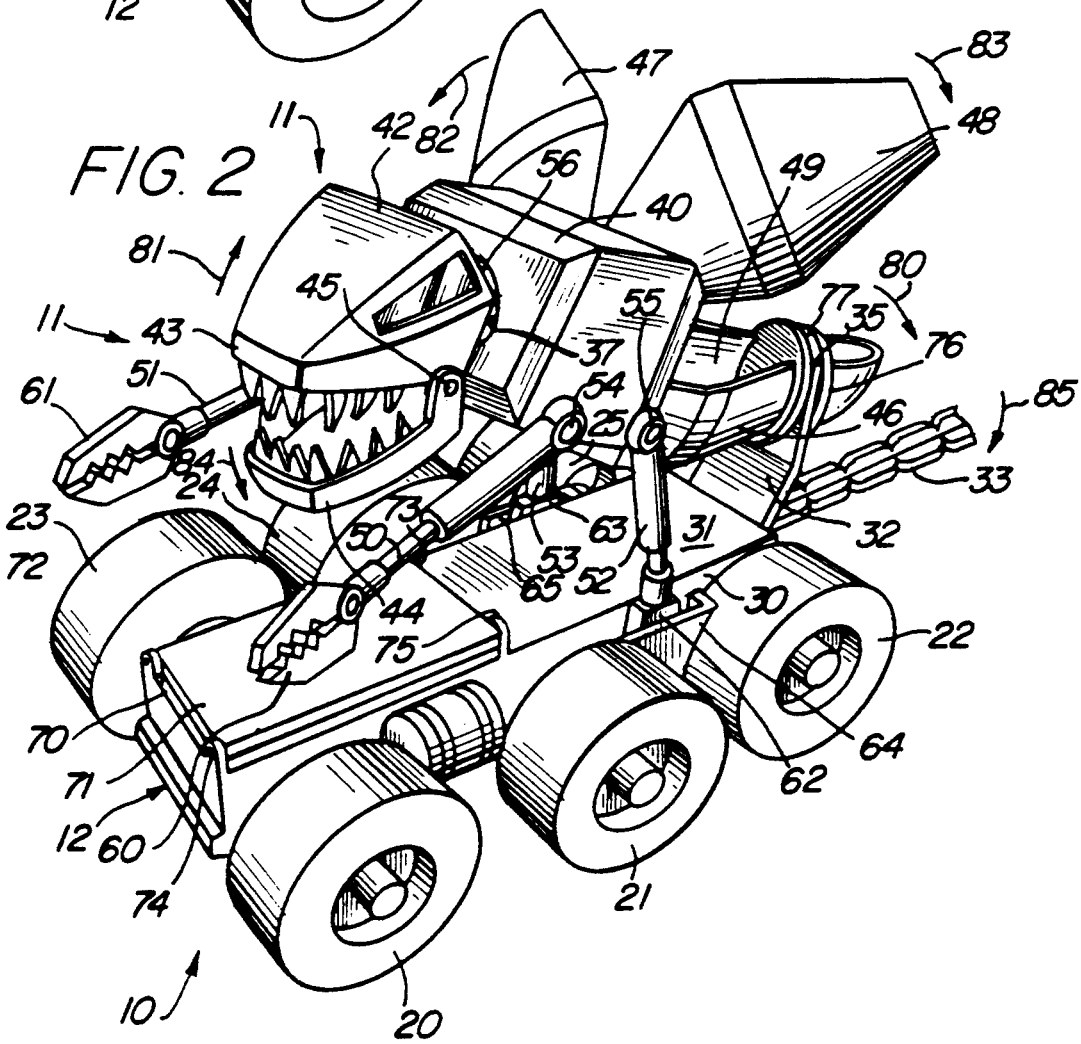
FIG. 2 sets forth a perspective view of the present invention multiple configuration toy vehicle in its open configuration providing a fanciful insect monster configuration.

Creature 11 further includes a pair of front legs 50 and 51 and a pair of rear legs 52 and 53 (legs 51 and 53 better seen in FIG. 2). Legs 50 and 52 are pivotally secured to center body 40 by conventional pivotal attachment means including a pair of cylindrical pins 54 and 55 respectively. While not visible in FIG. 1 due to the perspective view thereof, legs 51 and 53 are pivotally secured to the opposite side of center body 40 in an identical pivotal attachment using conventional pivot pins in the manner shown for legs 50 and 52.

In the closed configuration shown in FIG. 1, legs 52 and 53 are received within receptacles 64 and 65 respectively (the latter seen in FIG. 2) while front legs 50 and 51 extend forwardly between wheels 20 and 23 respectively and chassis 12. In accordance with design preference, chassis 12 may include an additional pair of claw receptacles similar to receptacles 64 and 65 to receive legs 50 and 51. Alternatively, legs 50 and 51 may simply rest between wheels 20 and 23 and the sides of chassis 30 as preferred. In either event, toy vehicle 10 may be operated in the closed position in accordance with typical toy vehicle play patterns in which the child user grasps the toy vehicle at a convenient point and rolls the toy vehicle on a play surface.

FIG. 2 sets forth a perspective view of toy vehicle 10 assuming an alternate configuration and separating creature from chassis 12. As set forth above, chassis 12 includes an elongated chassis bed 30 defining an upper surface 31. A pair of flaps 70 and 71 are pivotally coupled to upper surface 31 of chassis bed 30 by a plurality of hinges 72 through 75. Hinges 72 through 75 are constructed in accordance with conventional fabrication techniques such that hinges 72 and 73 pivotally support lower flap 70 while hinges 74 and 75 pivotally support upper flap 71. A plurality of wheels 20 through 25 are rotatably supported upon chassis 12 in accordance with conventional fabrication techniques. Chassis 12 further defines a pair of claw receptacles 64 and 65 which receive claws 62 and 63 respectively of rear legs 52 and 53.

Figure 7:
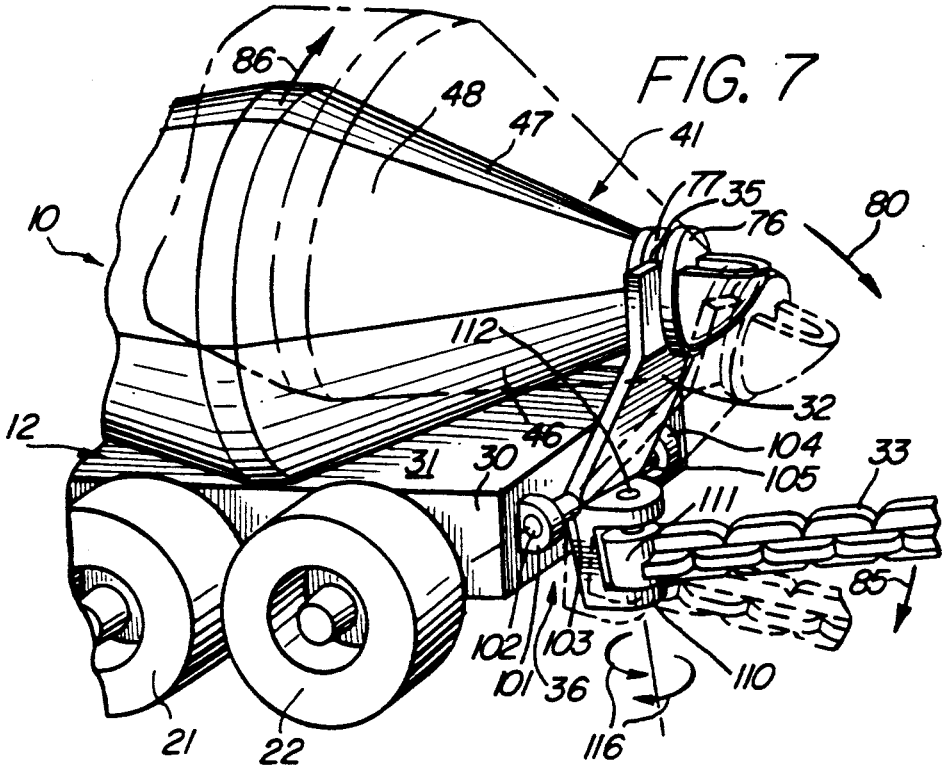
FIG. 7 sets forth a partial rear perspective view of the present invention multiple configuration toy vehicle.

Chassis 12 further includes an upwardly extending rear support 32 which in the manner set forth below in FIG. 7 is pivotally secured to the rear portion of chassis bed 30. Rear support 32 defines an upwardly facing notch 35. An elongated rigid simulated chain 33 is secured to rear support 32 in the manner shown in FIG. 7 and is generally pivotable in combination with rear support 32 in the manner described below in greater detail.

Creature 11 is formed of a generally rectangular center body 40 having a generally wedge-shaped head 42. Head 42 defines a cylindrical neck extension 56 while center body 40 defines an aperture 37 receiving neck 56 to provide a loose coupling between neck 42 and center body 40. Head 42 defines a stationary upper jaw 43 and a movable lower jaw 44. A hinge mechanism 45 pivotally couples lower jaw 44 to head 42 leaving lower jaw 44 freely movable between the open position shown in FIG. 2 and the closed position shown in FIG. 1. A plurality of legs 50, 51, 52 and 53 supporting respective claw members 60, 61, 62 and 63 are pivotally secured to center body 40. By way of illustration, legs 50 and 52 are pivotally secured to center body 40 by pivot pins 54 and 55 respectively. While not seen in FIG. 2, it should be understood that legs 51 and 53 are similarly coupled to the opposite side of center body 40 in the manner shown for legs 50 and 52.

Creature 11 further includes a rear body 41 formed of a lower portion 46 and a pair of wings 47 and 48. As is set forth below in greater detail, wings 47 and 48 are pivotally supported and are moved to the open positions shown in FIG. 2 as creature 11 is raised from the closed position of FIG. 1 to the open position of FIG. 2.

In operation, creature 11 is raised and opened to the position shown in FIG. 2 from the position shown in FIG. 1 by a downward force applied to simulated chain 33 causing chain 33 to pivot in the direction indicated by arrow 85. The coupling between chain 33 and rear support 32 set forth in FIG. 7 in greater detail causes rear support 32 to pivot rearwardly and downwardly in the direction indicated by arrow 80. The secure coupling between flange 76 of lower portion 46 and rear support 32 causes creature 11 to pivot upwardly in the direction indicated by arrow 81. The upward pivotal motion of creature 11 raises front legs 50 and 51 which in turn raises claws 60 and 61. Concurrently, the loose coupling between head 42 and center body 40 permits head 42 to tilt downwardly as center body 40 is raised. As center body 40 is lifted and head 42 is carried upwardly in the direction indicated by arrow 81, lower jaw 44 pivots downwardly in the direction indicated by arrow 84 due to the force of gravity thereon. By means set forth more clearly in FIGS. 5 and 6, the upward motion of lower portion 46 of rear body 41 and center body 40 causes center body 40 to pivot with respect to lower portion 46 which in turn causes wings 47 and 48 to be raised upwardly and pivot outwardly in the directions indicated by arrows 82 and 83 respectively.

Thus, as the pivotal motion of simulated chain downwardly in the direction of arrow 85 continues and a corresponding pivotal motion of rear support 32 is produced, creature 11 is lifted from chassis 12 by the attachment of rear support 32 to flange 76 causing creature 11 to be fully supported by lower portion 46 and rear support 32. As a result, the gravity induced motions of head 42 and center body 40 with respect to lower portion 46 described below in greater detail produces the opening motion of wings 47 and 48 and configures creature 11 in the open position shown in FIG. 2. Thereafter, the child user is able to simply remove creature 11 from its attachment to rear support 32 by drawing creature 11 upwardly and thereby withdrawing rear support 32 from groove 77 in flange 76. Once creature 11 has been removed from chassis 12, flaps 70 and 71 may be opened to the configuration shown in FIG. 9 to provide a more fanciful appearance for chassis 12.

Creature 11 may be returned to its attachment to chassis 12 by simply positioning flange 76 above rear support 32 such that groove 77 is aligned with notch 35. Thereafter, flange 76 is lowered into notch 35 of rear support 32 such that groove 77 is engaged and lower portion 46 is again coupled to rear support 32 in the manner shown in FIG. 2. Once the coupling is complete, claws 62 and 63 are aligned with and received within claw receptacles 64 and 65 respectively while claws 60 and 61 of front legs 50 and 51 respectively are aligned with the spaces between wheels 20 and 23 respectively and the sides of chassis bed 30. With this alignment complete, the user then releases creature 11 permitting the gravitational force thereon to pivot creature 11 downwardly and pivot rear support 32 and simulated chain 33 to the raised positions shown in FIG. 1 as creature 11 again comes to rest upon upper surface 31 of chassis bed 30. As lower jaw 44 is brought into contact with the upper surface of upper flap 71, it pivots to the closed position shown in FIG. 1. Concurrently, as center body 40 is brought to rest upon upper surface 31 of chassis bed 30, the pivotal force upon wings 47 and 48 is released and wings 47 and 48 pivot inwardly to reassume the closed position shown in FIG. 1.

It should be noted that the entire action of creature 11 both in the open and closed mode results from gravitational forces without the use of spring biasing members or the like thereby rendering the manufacture of toy vehicle 10 to be relatively low cost and free of unnecessary complexity or difficulty of operation.

Figure 3:
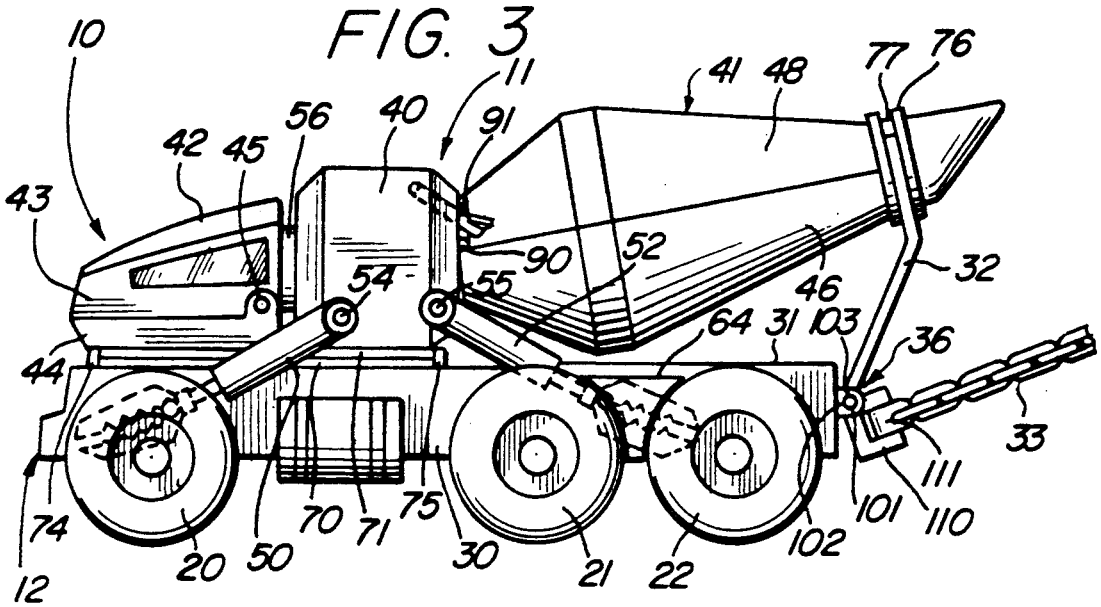
FIG. 3 sets forth a side view of the present invention multiple configuration toy vehicle assuming the configuration shown in FIG. 1.

FIG. 3 sets forth a side view of toy vehicle 10 in the closed position shown in FIG. 1. As described above, toy vehicle 10 includes a chassis 12 having a plurality of supporting wheels 20, 21, 22 as well as wheels 23 through 25 (seen in FIG. 2). Chassis 12 includes an elongated chassis bed 30 having an upper surface 31 which supports a pair of foldable flaps 70 and 71. Flap 71 is supported by hinges 74 and 75 while flap 70 is supported by hinges 72 and 73 (seen in FIG. 2). Creature 11 includes a center body 40 coupled to a head 42 and a rear body 41. Center body 40 supports legs 50 and 52 using a pair of pins 54 and 55 respectively. Center body 40 also supports legs 51 and 53 in a similar attachment (seen in FIG. 2).

Creature 11 further includes a head 42 defining a neck 56 coupled to center body 40 by means set forth below in FIG. 4 as well as a fixed jaw 43 and a movable jaw 44. Movable jaw 44 is pivotally secured to head 42 by a hinge 45. Rear body 41 includes a lower portion 46 and a pair wings 47 and 48 (the former seen in FIG. 1). Rear body 41 further includes a flange 76 defining a groove 77 therein. A rear support 32 defines a notch 35 (better seen in FIG. 5) which receives flange 76 within groove 77. Rear support 32 is pivotally secured to chassis bed 30 by a pivotal assembly 36 (the details of which are set forth more clearly in FIG. 7). Suffice it to note here, however, that pivotal assembly 36 includes a flange 101 defining an aperture 102 which receives a horizontally disposed shaft 103 to provide pivotal motion of rear support 32 about a horizontal axis. Rear support 32 terminates in a coupling member 110 which receives end 111 of simulated chain 33 in a pivotal attachment shown more clearly in FIG. 7. Wing 48 is pivotally secured to lower portion 46 by a hinge 90. An arm 91 is secured to wing 48 and is received within aperture 94 (seen in FIG. 4) of center body 40. As is better seen in FIG. 5, wing 47 defines a similar hinge 92 and arm 93 providing a pivotal attachment of wing 47 to lower portion 46 of rear body 41.

Thus, in the closed position shown in FIG. 3, creature 11 defines its closed configuration and is coupled to and rests upon chassis 12. As a result, toy vehicle 10 is utilized in accordance with typical play patterns for play vehicles in which vehicle 10 may be rolled about a play surface or the like.

Figure 4:
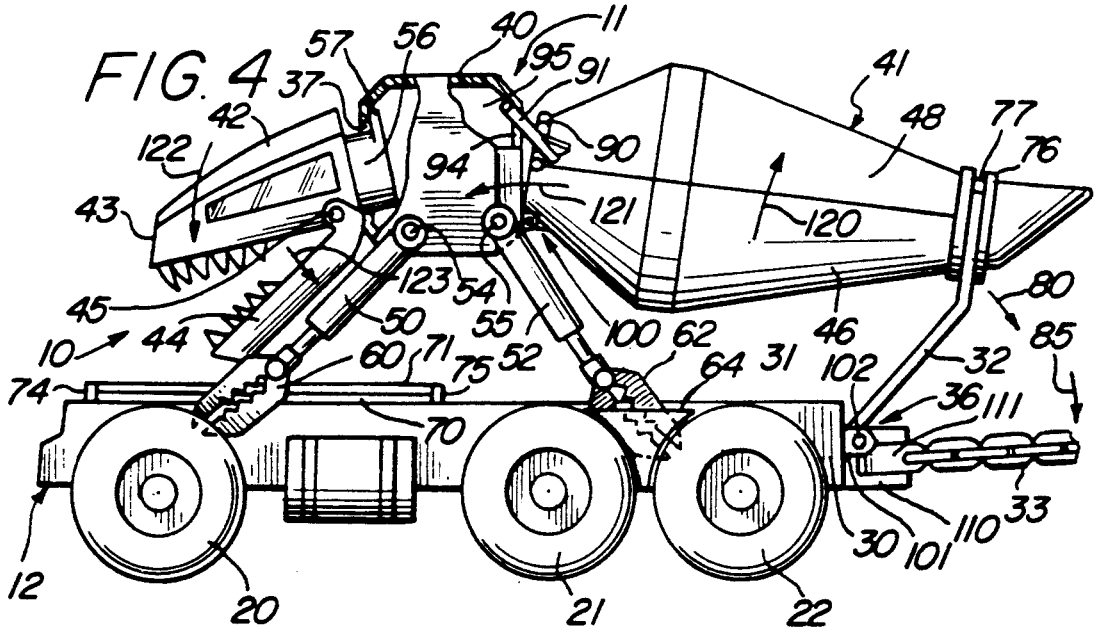
FIG. 4 sets forth a partially sectioned side view of the present invention multiple configuration toy vehicle during transition between alternative configurations.

FIG. 4 sets forth a partially sectioned view of toy vehicle 10 as the transition to the open position shown in FIG. 2 is undertaken. Thus, as is described above, chassis 12 includes an elongated chassis bed defining an upper surface 31 and a pair of claw receptacles 64 and 65 (the latter seen in FIG. 1). Chassis 12 further supports a pair of flaps 70 and 71 foldably received upon upper surface 31. As is also set forth above, creature 11 includes a center body 40, a head 42 and a rear body 41. Center body 40 supports legs 50 and 52 in pivotal attachment using pins 54 and 55. Legs 50 and 52 define respective claws 60 and 62. Center body 40 further defines an aperture 37 on the frontal side thereof and an aperture 94 on the rear side thereof. Head 42 defines a neck 56 extending through aperture 37 and an interior tab 57 maintaining neck 56 in its attachment to center body 40. Head 42 further defines a stationary jaw 43 and a movable jaw 44 secured at a hinge 45.

Rear body 41 includes a pivot 100 pivotally securing lower portion 46 of rear body 41 to center body 40. Wing 48 is pivotally secured to lower portion 46 by a hinge 90 and further includes an arm 91 extending through aperture 94 of center body 40. As is better seen in FIG. 5, wing 47 defines a similar hinge 92 and arm 93 coupling wing 47 to lower portion 46 of body 41.

In the position shown in FIG. 4, simulated chain 33 has been pivoted downwardly in the direction indicated by arrow 85 causing rear support 32 to pivot about pivot assembly 36 in the direction indicated by arrow 80. The coupling between rear support 32 and flange 76 within groove 77 causes rear body 41 in the direction indicated by arrow 120 raising creature 11 upwardly from chassis 12. As creature 11 is raised, the gravitational force upon center body 40 and head 42 causes center body 40 to pivot downwardly with respect to rear body 41 in the direction indicated by arrow 121. Similarly, the gravitational force upon head 42 causes head 42 to pivot downwardly with respect to center body 40 in the direction indicated by arrow 122. The loose coupling of lower jaw 44 permits lower jaw 44 to pivot downwardly in the direction indicated by arrow 123 to assume the open position shown in FIG. 4.

Once creature 11 has been pivoted upwardly in the manner shown in FIG. 4, the child user then simply removes creature 11 from chassis 12 by grasping a convenient point such as body 40 and withdrawing flange 76 from rear support 32. As creature 11 is fully withdrawn from contact with chassis 12 and rear support 32, rear body 41 pivots about pivot 100 with respect to center body 40 due to gravitational force which in turn by means set forth in FIGS. 5 and 6 opens wings 47 and 48 to the position shown in FIG. 2.

Figure 5:
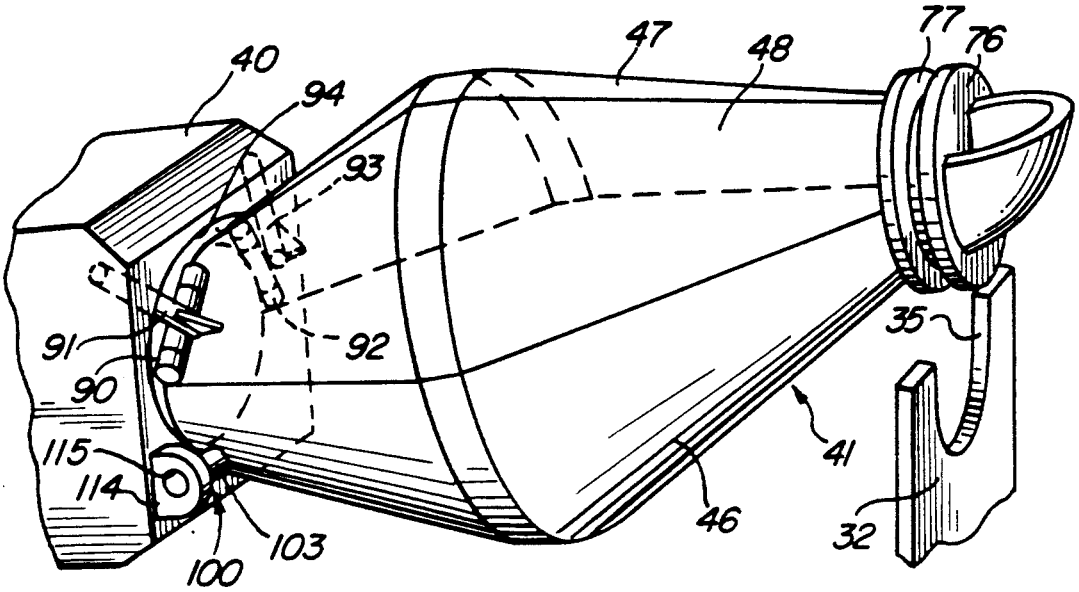
FIG. 5 sets forth a partial perspective view of the rear portion of the present invention multiple configuration toy vehicle during configuration transition.

FIG. 5 sets forth a partial rear perspective view of creature 11 setting forth the structure providing the gravitational actuated wing opening mechanism of the present invention. Thus, center body 40 defines an aperture 94 and a pivot 100 pivotally supporting lower portion 46 of rear body 41. Pivot 100 includes a flange 114 extending rearwardly from center body 140 and defining an aperture 115. Pivot 100 further includes a shaft 113 extending outwardly from lower portion 46 into aperture 115 of flange 114. While not seen in FIG. 5 due the perspective view thereof, pivot 100 preferably includes a second flange and shaft coupling identical to flange 114 and shaft 113 on the opposite side of lower portion 46 of rear body 41. Rear body 41 includes wings 47 and 48 pivotally secured to lower portion 46 by a pair of angularly oriented hinges 90 and 92. In their preferred form, hinges 90 and 92 are angled at approximately forty-five degrees from the vertical axis of center body 40 to provide pivotal motion which is both upwardly and outwardly as wings 47 and 48 are pivoted away from lower portion 46 of rear body 41. Wing 48 further includes a forwardly angled rigid arm 91 extending forwardly and upwardly from wing 48 through aperture 94 of center body 40 and into interior cavity 95 (seen in FIG. 6) of center body 40. Similarly, wing 47 includes a forwardly and upwardly extending arm 93 also passing through aperture 94 of center body 40.

In the closed position shown in FIG. 5, creature il is being initially removed from rear support 32 by withdrawing flange 76 from notch 35. As the gravitational force acts upon rear body 41 causing rear body 41 to pivot downwardly about pivot 100, rear body 41 assumes the open position shown in FIG. 2.

Figure 6:
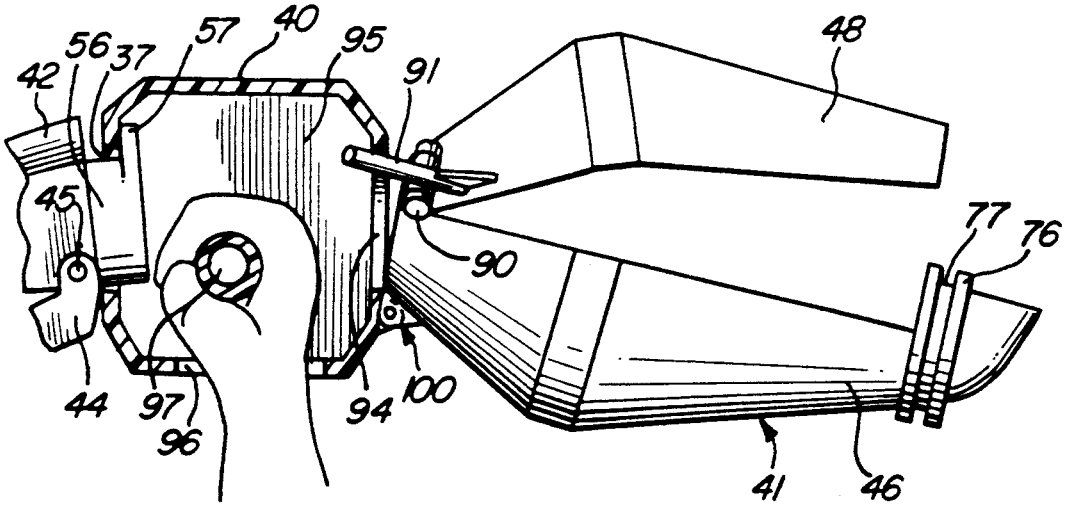
FIG. 6 sets forth a partial section view of the present invention multiple configuration toy vehicle.

FIG. 6 sets forth a partial section view of creature 11 in typical use by a child user. Thus, as described above, creature 11 includes a center body 40, a head 42 and a rear body 41. Center body 40 defines an interior cavity 95, a front aperture 37 and a rear aperture 94. Center body 40 further defines a downwardly facing aperture 96 and a handle 97 extending transversely through interior cavity 95. Thus, a child user is able to manipulate creature 11 by inserting the user's hand through aperture 96 into interior cavity 95 and grasping handle 97. This supports the entirety of creature 11 by center body 40. As described above, head 42 defines a neck 56 loosely received within aperture 37 and loosely coupled to center body 40 by tab 57. As is also described above, lower portion 46 of rear body 41 is pivotally secured to center body 40 by pivot 100, the details of which are set forth above in FIG. 5. Wing 48 includes an angularly disposed hinge 90 and upwardly extending arm 91. The latter is received within aperture 94 in the manner described above.

Thus, as creature 11 is supported entirely by the user's control of center body 40, the gravitational force upon head 42 pivots head 42 downwardly and opens lower jaw 44. Similarly, the gravitational force upon lower portion 46 of rear body 41 pivots lower portion 46 downwardly about pivot 100 which in turn moves hinge 90 downwardly and away from center body 40. The cooperation of arm 91 against the upper surface of aperture 94 during this downward pivotal motion of lower portion 46 causes wing 48 to be pivoted upwardly and outwardly about hinge 90 and thus raises wing 48 to the open position shown in FIG. 2. It should be understood that while not seen in FIG. 6, a similar pivoting action is imparted to wing 47 through the cooperation of arm 93 and hinge 92 to pivot wing 47 to the open position shown in FIG. 2 also.

Once creature 11 has been grasped by the user in the manner shown in FIG. 6, the user may manipulate lower portion 46 about pivot 100 with the user's remaining hand to alter the angular disposition of wings 47 and 48 and provide a wing flapping action to simulate flying of creature 11. Once again, it should be noted that the entire mechanism is gravity actuated and thus the complexity of various springs and other interactive mechanisms are not needed in the present invention structure.

FIG. 7 sets forth a partial rear perspective view of toy vehicle 10 in the closed position. Thus, as described above, toy vehicle 10 includes a chassis 12 having a chassis bed 30 and a creature 11 having a rear body 41. A rear support 32 is coupled to flange 76 of rear body 41 in the above-described supportive attachment. A horizontal pivot assembly 36 includes a pair of rearwardly extending flanges 101 and 104 defining respective apertures 102 and 105. A shaft 103 extends through apertures 102 and 105 and is coupled to rear support 32. Rear support 32 further defines a coupling 110 receiving end 111 of simulated chain 33 in a pivotal attachment about a pin 112.

Thus, the attachment of rear support 32 at horizontal pivot assembly 36 permits support 32 to undergo the pivotal motion indicated by arrow 80 and described above to raise rear body 41 upwardly in the direction indicated by arrow 86 as simulated chain 33 is forced downwardly in the direction indicated by arrow 85. Concurrently, the pivotal coupling between end 111 and coupling 110 facilitate the axial motion of simulated chain 33 to move simulated chain 33 in the manner indicated by arrows 116.

Figure 8:
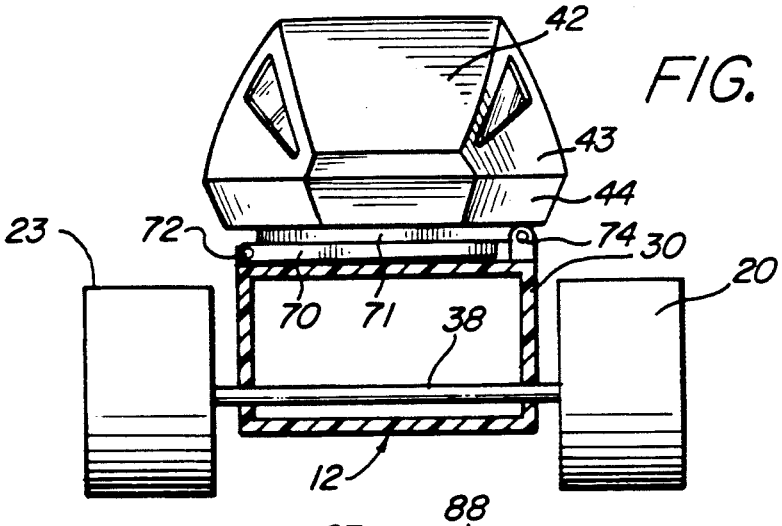
FIG. 8 sets forth a partially sectioned frontal view of the present invention multiple configuration toy vehicle.
Figure 9:
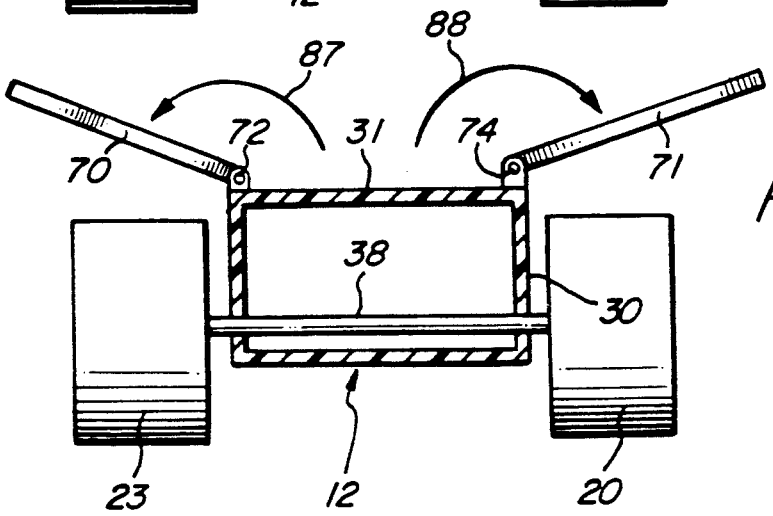
FIG. 9 sets forth a partially sectioned frontal view of the chassis portion of the present invention multiple configuration toy vehicle.

FIGS. 8 and 9 taken together set forth the action of movable flaps 70 and 71. In FIG. 8, head 42 of creature 11 is received upon flaps 70 and 71 in the closed position upon chassis bed 30 permitting vehicle 10 to be moved about upon the support provided by the plural rolling wheels includes wheels 20 and 23 having supporting axle 38 extending through chassis bed 30. In FIG. 9, creature 11 has been withdrawn from chassis 12 and flaps 70 and 71 are pivoted outwardly about hinges 72 and 74 in the direction indicated by arrows 87 and 88 permitting chassis 12 to assume an open alternate configuration is so desired by the child user.

What has been shown is a multiple configuration toy vehicle which is removably supported upon a rolling chassis and which is configurable solely in response to gravitational force upon the multiply articulated elements thereof. The need for complex springs and other mechanisms is avoided.

That which is claimed is:

1. A toy vehicle comprising:

a chassis;

a pivotal support member pivotally coupled to said chassis;

a simulated creature having a center body portion and a rear body portion pivotally coupled thereto;

means for attaching said rear body portion to said pivotal support member such that said rear body portion and said center body portion are restable upon said chassis in a relaxed position and pivotable upwardly therefrom in a raised position, said body portions pivoting with respect to each other when in said raised position;

a pair of simulated wings; and actuating support means coupled said rear body portion supporting said pair of simulated wings in a closed position when said rear body portion and said center body portion are in said relaxed position and engaging said center body portion moving said pair of simulated wings to an open diverging position when said rear body and said center body portion are pivoted with respect to each other as they are moved to said raised position.

2. A toy vehicle as set forth in claim 1 further including a head loosely coupled to said center body portion having a movable jaw pivotally coupled to said head, said head tilting downwardly and said jaw pivoting open when said creature is lifted.

3. A toy vehicle as set forth in claim 2 wherein said means for attaching includes:

a flange formed on said rear body portion and defining a groove; and an upwardly open notch formed in said pivotal support member for receiving said flange in a sliding attachment.

4. A toy vehicle comprising:

a chassis defining an upper surface and front and rear ends;

a rear support, having first attachment means, pivotally coupled to said rear end of said chassis;

a toy creature defining a center body, a rear body and pivotal coupling means therebetween;

second attachment means formed on said rear body for removably attaching said rear body to said first attachment means; and a pair of wings pivotally secured to said rear body having coupling means for pivoting said wings to an open position when said rear body pivots with respect to said center body, said toy creature resting upon said upper surface of said chassis in a lowered position such that said center body and rear body are generally aligned and said pair of wings are closed and generally aligned and said toy creature being raised to an open position above said surface as said rear support is pivoted in which said center body tilts downwardly and said wings pivot outwardly.

5. A toy vehicle as set forth in claim 4 further including a head loosely coupled to said center body.

6. A toy vehicle as set forth in claim 5 wherein said center body defines an interior cavity and a downwardly open aperture and a handle supported within said interior cavity.

7. A toy vehicle as set forth in claim 6 wherein said coupling means include:

a pair of angularly oriented hinges coupling said wings to said rear body to be pivotable upwardly and outwardly from said rear body; and a pair of arms extending from each of said wings engaging said center body.

8. A toy vehicle as set forth in claim 5 wherein said center body defines an interior cavity a downwardly open aperture and a generally cylindrical handle supported within said interior cavity.

* * * * *